United States Patent [19]

Wingert

[11] 4,259,856

[45] Apr. 7, 1981

[54] COMBINATION LOCKS AND DIAL-INDEXING SPRING THEREFOR

[75] Inventor: Rudolf Wingert, High Crest Lake, N.J.

[73] Assignee: Presto Lock Company, Division of Walter Kidde & Company, Inc., Garfield, N.J.

[21] Appl. No.: 26,570

[22] Filed: Apr. 3, 1979

[51] Int. Cl.[3] ..... E05B 37/12

[52] U.S. Cl. ..... 70/70; 70/312; 70/327; 70/DIG. 55

[58] Field of Search ..... 70/67, 69, 70, 71, 72, 70/73, 74, 75, 76, 312, 327, 328, DIG. 55

[56] References Cited

U.S. PATENT DOCUMENTS

| | | | |
|---|---|---|---|
| 3,196,237 | 7/1965 | Westgate . | |
| 3,300,594 | 1/1967 | Paine . | |
| 3,416,338 | 12/1968 | Gehrie | 70/69 |
| 3,858,420 | 1/1975 | Sallis | 70/81 |
| 3,975,601 | 8/1976 | Whelan . | |
| 4,034,178 | 7/1977 | Koppenheffer . | |
| 4,082,925 | 4/1978 | Hufford . | |
| 4,131,771 | 12/1978 | Erickson . | |
| 4,155,234 | 5/1979 | Bako | 70/312 |

*Primary Examiner*—Robert L. Wolfe
*Attorney, Agent, or Firm*—Shapiro & Shapiro

[57] ABSTRACT

A pair of combination locks is employed to hold the lid of a luggage case locked closed, with a left-hand lock operating as a mirror image of a right-hand lock. Principal parts of the locks, including improved dial-indexing springs (but not the dials) are interchangeable. The dial-indexing springs cooperate with the dials of left-hand and right-hand locks in the same manner, so that all of the dials have the same action.

11 Claims, 7 Drawing Figures

COMBINATION LOCKS AND DIAL-INDEXING SPRING THEREFOR

BACKGROUND OF THE INVENTION

This invention relates to combination locks and is more particularly concerned with an improved dial-indexing spring that is used in left-hand and right-hand locks interchangeably.

Combination locks are commonly employed on luggage cases, such as suitcases or attache cases, to hold the lid or cover locked closed until combination dials are turned to a predetermined combination. Frequently a luggage case has a pair of combination locks located at opposite sides of a carrying handle. If identical locks are employed and are oriented identically, the lock arrangement may be asymmetrical. For example, both locks may have a manual actuator at the right end of the lock which is moved to the right to release a hasp at the left end of the lock. If one lock were simply turned 180° relative to the other in an effort to achieve symmetry, indicia on combination dials of one of the locks would be inverted. It is preferred to employ an arrangement of locks that is symmetrical, but with all the combination dials operating identically.

While this arrangement is very convenient as well as physiologically and psychologically attractive to the user, it may have certain disadvantages from the standpoint of the lock manufacturer. Although principal parts of the lft and right locks can be made interchangeable and assembled to operate in the desired direction, preferred lock mechanisms do not permit use of the same combination dials in both the right-hand and left-hand locks, and thus left-hand and right-hand dials must be manufactured. Moreover, dial-indexing springs which have heretofore been employed in such lock mechanisms cannot be used for both left-hand and right-hand locks, again necessitating the manufacture of different left-hand and right-hand parts.

BRIEF DESCRIPTION OF THE INVENTION

It is accordingly an object of the present invention to provide combination locks for use as a pair on a luggage case, with left-hand and right-hand locks that are symmetrical about a carrying handle of the case and that employ dial-indexing springs that are interchangeable.

A further object of the invention is to provide combination locks, as aforesaid, in which the action of all the combination dials as perceived by the user is the same.

Still another object of the invention is to provide an improved dial-indexing spring for a combination lock.

An additional object of the invention is to provide a dial-indexing spring which cooperates with the dials of a left-hand combination lock in the same manner as with the dials of a right-hand combination lock.

Yet another object of the invention is to provide a dial-indexing spring that holds the dials of a combination lock more firmly in place than comparable springs employed heretofore and that improves the dial rotation action.

Briefly stated, in one of its broader aspects, the invention is employed in a combination lock having a shaft, a plurality of combination dials supported for rotation on the shaft, each dial having combination indicia spaced about its periphery and having indexing members spaced about its periphery and disposed so that an indexing member is located between each pair of successive indicia, and latch means operable to an open position only when the dials are turned to a predetermined orientation, and comprises improved dial indexing spring means including a base, and a pair of resilient arms for each of the dials, respectively, the arms of each pair originating at opposite edge regions of the base and extending away from the base toward each other and toward the periphery of the corresponding dial and having free ends engaging indexing members, respectively, of the corresponding dial.

BRIEF DESCRIPTION OF THE DRAWINGS

The invention will be further described in conjunction with the accompanying drawings, which illustrate a preferred and exemplary embodiment, and wherein.

DETAILED DESCRIPTION OF A PREFERRED EMBODIMENT

Figure 1:
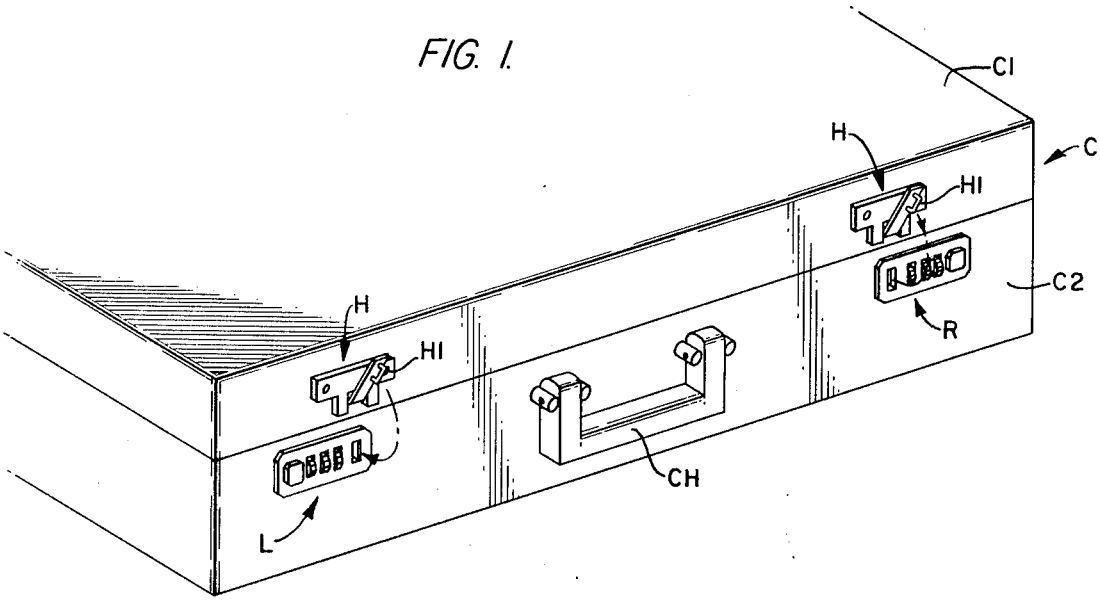
FIG. 1 is a partial perspective view illustrating the use of a pair of combination locks on a luggage case.

Referring to the drawings, as shown in FIG. 1 a pair of combination locks L and R may be employed on a luggage case C. As is conventional, the case has a pair of parts C1 and C2 connected by hinges (not shown) along a side of the parts opposite to the side associated with the locks. Part C1 may be a lid of the case that is to be locked closed upon part C2. Accordingly, hasp assemblies H are mounted on the lid for cooperation with locks L and R. Each hasp assembly may have a conventional spring-biased pivoted hasp H1 which may be turned to engage the associated combination lock as indicated by the arrows. When the hasps are so engaged, lid C1 is held closed and may be opened only when both locks L and R are set on combination and actuated so that the hasp springs release the hasps. Conventionally, case C has a carrying handle CH about which locks L and R are symmetrically disposed. The invention will now be described in detail with reference to an illustrative type of combination lock. Although a right-hand lock will be described, with modifications to be noted it will become apparent that the description suffices for a left-hand lock also. Moreover, it will become apparent that the invention may be incorporated in other types of combination locks.

Figure 2:
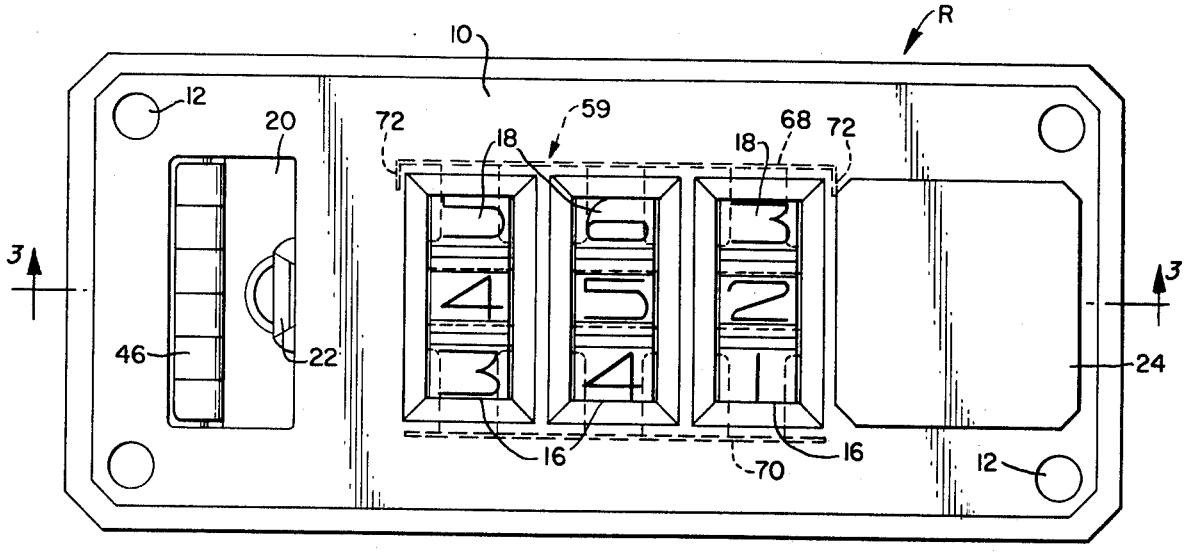
FIG. 2 is a plan view illustrating one of the locks (the right-hand lock in this instance)
Figure 4:
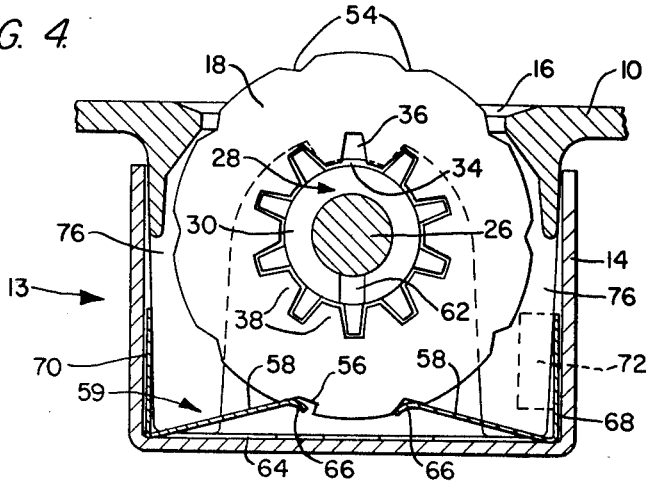
FIG. 4 is a transverse sectional view taken along line 4—4 of FIG. 3.
Figure 3:
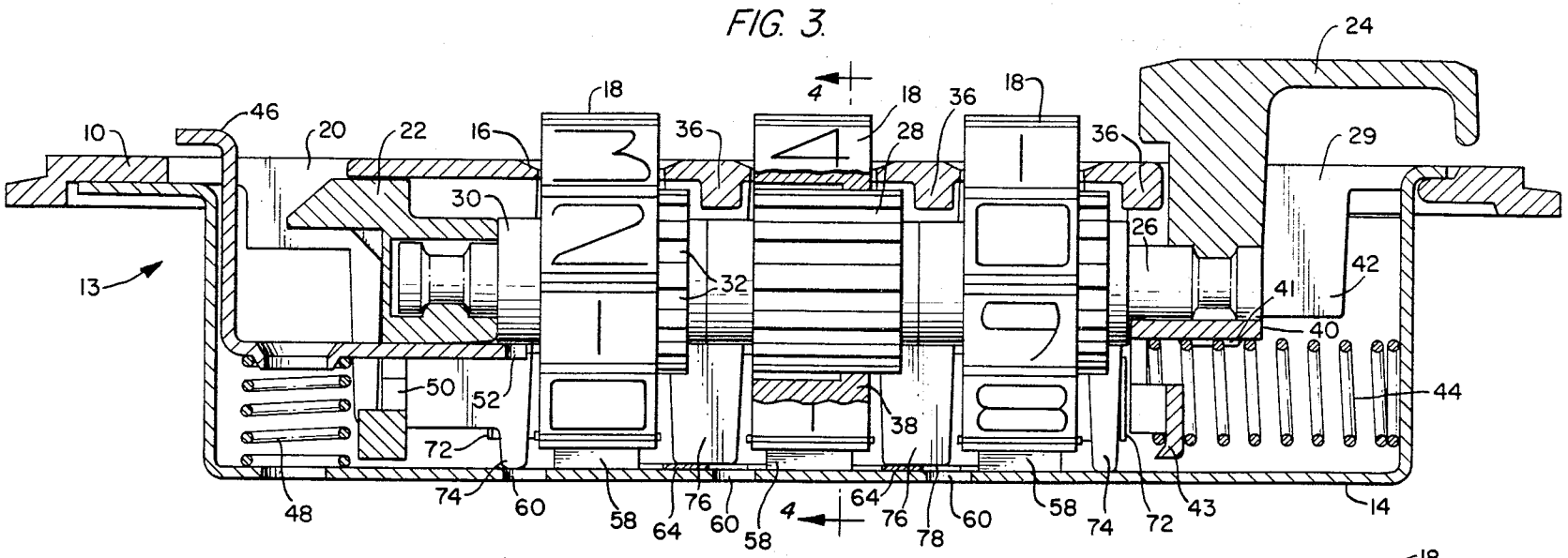
FIG. 3 is a longitudinal sectional view of the lock of FIG. 2 taken along line 3—3 thereof.

As shown in FIG. 2, lock R may have a face plate 10 provided with openings 12 for receiving rivets or other fasteners which attach the lock to the case C. As shown in FIGS. 3 and 4, a lock housing 13 may be constituted by the face plate 10 and a frame 14, which may be secured to the face plate in a conventional manner (as by rivets) and which is inserted in a corresponding opening in a wall of part C2 of the case when the lock is mounted on the case.

Face plate 10 has a plurality of slots 16 through which combination dials 18 protrude, respectively. Each dial has a series of combination indicia spaced about its periphery and capable of being exposed in a slot 16. A further slot 20 in the face plate receives the hasp H1 for engagement with a spring-biased bolt 22. The nose of the bolt that is exposed through slot 20 in FIG. 2 may be tapered to facilitate latching engagement of the bolt and the hasp as the hasp enters slot 20, depresses bolt 22 against the bias of its return spring (to be described) and is then latched with the bolt as the bolt spring returns the bolt to the position shown. Also shown in FIG. 2 is a manual actuator 24 which, as will be further explained, may move the bolt to release the hasp when dials 18 are set "on combination."

Figure 7:
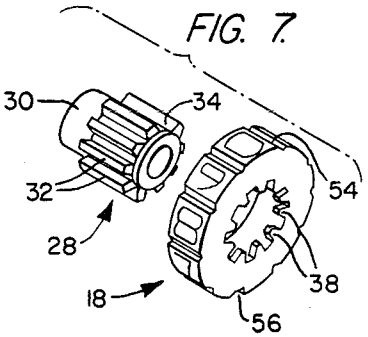

Referring to FIGS. 3, 4 and 7, each dial 18 is supported for rotation on a shaft 26 by means of a cooperable sleeve 28. One end of shaft 26 is connected to bolt 22 and the other end to actuator 24, which extends into housing 13 through an opening 29 in face plate 10. Each sleeve has a cylindrical hub 30 from which external gear teeth 32 radiate at one end of the hub. A gap 34 is provided by omitting one of the gear teeth 32 so that when the sleeve has a predetermined rotational position, it may be moved axially to bypass a corresponding blocking abutment 36 formed internally of the cover plate 10 as shown in FIGS. 3 and 4. Each dial 18 has internal gear teeth 38 at one end of the dial which are adapted to mesh with the external gear teeth 32 of the associated sleeve as shown in FIG. 3.

The sleeves are mounted on shaft 26 so that they abut successively and are embraced between bolt 22 and a bracket 40, which may be secured to actuator 24 by means of rivets 41, and which may slide longitudinally of frame 14 on the lower edge of bosses 42 that depend from face plate 10 at opposite sides of opening 29. Bracket 40 has a tang 43 engaging one end of a compression coil spring 44. It is apparent that when actuator 24 is moved to the right in FIG. 3, the assembly of actuator 24, bracket 40, bolt 22, shaft 26, and sleeves 28 moves to the right, compressing spring 44 against one end of the frame 14 and withdrawing the nose of the bolt from the hasp (which enters opening 20). When the actuator is released, the spring returns this assembly (which may be termed a "latching means") to the position illustrated in FIG. 3. Movement of actuator 24 to the right in FIG. 3 in order to release the hasp can only occur when all of the sleeves 28 have an orientation that places the gaps 34 in a position to bypass the blocking abutments 36. Otherwise, a gear tooth 32 of one or more of the sleeves will contact the associated blocking abutment 36 and prevent the movement just described that is required to open the lock. Sleeves 28 are turned to the required orientation for opening the lock by turning the associated dials 18 to predetermined positions. Turning the dials to these positions places the lock "on combination," the combination indicia then being centrally displayed in the slots 16 (see FIG. 2).

When the lock is set on combination and actuator 24 is moved, as described above, to open the lock, the sleeves move axially relative to the corresponding dials, but gear teeth 32 of the sleeves are not disengaged from the associated gear teeth 38 of the dials. When delivered by the manufacturer, the lock will have a predetermined combination, e.g., 0-0-0. To change the combination, the gear teeth of the sleeves must be disengaged from the gear teeth of the dials to permit the dials to rotate relative to the sleeves. This is accomplished by opening the lock and then shifting the assembly of actuator 24, bracket 40, shaft 26, bolt 22, and sleeves 28 (the "latching means") to a combination changing position farther to the right in FIG. 3 than the position required to open the lock.

In the lock illustrated a lever 46 protrudes through slot 20 of face plate 10 and must be depressed to permit the combination to be changed. When the lock is opened, the hasp pops out of opening 20, and the lever 46 is exposed to the user. The lever is biased to the position shown in FIG. 3 by a compression coil spring 48. Bolt 22, the lower end of which may ride along the bottom of frame 14 for guiding the reciprocative movement of the latch means, has a slot 50 through which lever 46 passes. The internal end 52 of the lever is enlarged laterally (toward and away from the viewer in FIG. 3) so that end 52 is too wide to pass through the upper portion of slot 50 when lever 46 is in the position illustrated in FIG. 3. This limits the rightward movement of the latch means in FIG. 3 to the position required to open the lock.

However, when lever 46 is depressed by the user (against the bias of spring 48) end 52 is aligned with a wider lower portion of slot 50, permitting the latch means to move beyond its normal open position to a combination changing position at which gear teeth of sleeves 28 are disengaged from gear teeth of dials 18. If the user releases lever 46 when actuator 24 has moved the latch means to the combination changing position, spring 48 will return the lever to the position shown in FIG. 3, and end 52 (not to the left of opening 50 in FIG. 3) will engage the lower portion of bolt 22 and prevent return movement of the latch means (leftward in FIG. 3). Dials 18 may thus be turned by the user to change the combination without holding lever 46 depressed. When the new combination has been selected, lever 46 is depressed again, permitting end 52 to pass through the lower (wider) portion of slot 50 as spring 44 returns the latch means to the position illustrated in FIG. 3.

So that the dials 18 may be indexed, that is, held at selected rotational positions at which indicia are centrally exposed in the slots 16 of the face plate, each dial is provided with indexing members 54 that cooperate with a dial spring. In the combination lock shown, the indexing members are notches formed in and spaced around the periphery of the dial, one notch being provided between each pair of successive combination indicia (a series of ten numerals in the illustrative lock). Preferably, each notch, except one, has a symmetrical V-shape with its sloping walls disposed symmetrically about a plane that is radial to the axis of shaft 26, as shown in FIG. 4. One notch, 56, of each dial is preferably asymmetrical and has a wall that is radial or almost radial, so as to form an abutment which stops rotation of the dial when the dial is turned in one direction to a predetermined position. As shown in FIG. 4, one arm 58 of a dial spring 59 (to be described) enters notch 56 when the dial is turned to a predetermined position, and if the rotation of the dial is in a particular direction (clockwise in FIG. 4) the free end of the spring arm engages the abutment surface of notch 56 and stops the rotation of the dial. The purpose of this arrangement is to permit the dial to be rapidly moved to a predetermined rotational position. For example, this position may be chosen so that numeral 0 is centrally exposed through the face plate slot 16, requiring that indexing notch 56 be located between numerals 5 and 6 on the periphery of the dial in the lock illustrated. As alluded to earlier, the lock may be set at combination 0-0-0 by the manufacturer when it is sold, and the feature just described permits the user to turn the dials to this combination rapidly if the dials get off combination. If the user prefers not to select a new combination, the dials may always be readily set at 0-0-0.

Figure 6:
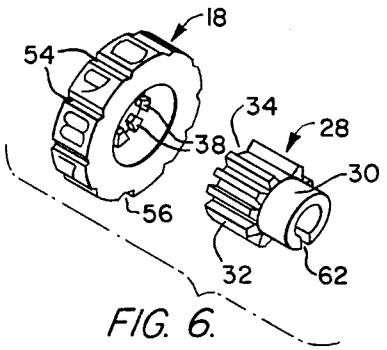
FIGS. 6 and 7 are exploded perspective views illustrating a dial of a left-hand lock and a dial of a right-hand lock, respectively, each with an associated sleeve that is engaged with the dial for rotation therewith.

If the combination is "lost" after the luggage case has been opened, it may be readily "found" by inserting a probe through each of finder holes 60 formed in the bottom wall of frame 14 opposite to each of the sleeve hubs 30 as shown in FIG. 3. Each hub is provided with a notch 62, as shown in FIG. 6, and when the notch is aligned with the corresponding hole 60 to receive the probe, the gap 34 in the gear teeth 32 of the sleeve will be positioned to bypass the corresponding blocking abutment 36.

Generally, the combination lock structure and functions described so far are disclosed in U.S. Pat. No. 4,123,923, granted Nov. 7, 1978, and assigned to the same assignee as the present invention, but details of the structure just described differ from those disclosed in the patent. An earlier U.S. Pat., No. 3,416,338, granted Dec. 17, 1968, and also assigned to the same assignee as the present invention, discloses another combination lock having structure similar in certain respects to that just described. Both patents are incorporated herein by reference. The present invention may be incorporated in the locks of both patents, for example.

As earlier stated, the present invention is particularly directed to the problem of providing left-hand and right-hand locks on a luggage case. Except for the combination dials, the parts of the left-hand lock and the right-hand lock employed in accordance with the present invention may be identical (although it is preferred to provide separate left-hand and right-hand face plates when it is desired that the manufacturer's name thereon appear with the same orientation on both locks). Ignoring for the moment the matter of the different dials for the left-hand and the right-hand locks, and ignoring the dial spring for the moment, the parts illustrated in FIGS. 2, 3 and 4 may be employed in left-hand and right-hand locks interchangeably. When a pair of locks is mounted in left-hand and right-hand orientations, as in FIG. 1, the locks appear to the user as mirror images (except, strictly speaking, the dials, which appear to be identical). The dials must be manufactured in left-hand and right-hand versions, as shown in FIGS. 6 and 7, if the same number orientation and sequence is to be preserved and if the same disposition of unique notch 56 is desired. In accordance with the present invention, the dial springs are interchangeable, however.

Figure 5:
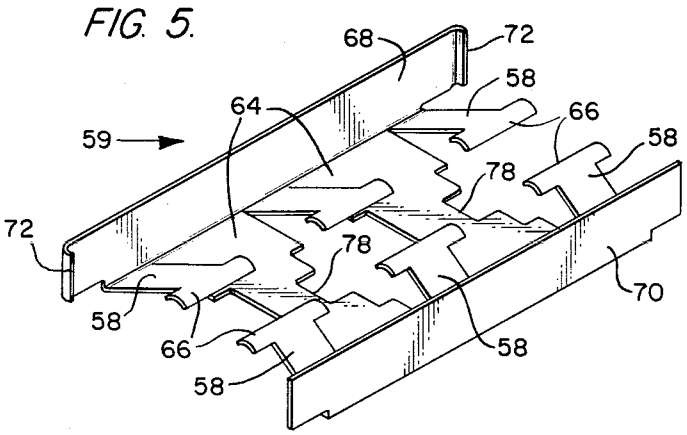
FIG. 5 is a perspective view of an improved dial spring of the invention.

The dial-indexing spring 59 is best seen in FIG. 5. In the preferred form there are three pairs of arms 58, which cooperate, respectively, with three combination dials. The dial spring is preferably formed from a single strip of springy material, such as spring temper phosphorus bronze, and the arms 58 are preferably struck from opposite edge regions of a generally rectangular base 64, successive pairs of arms being separated by portions of the base as shown. As is apparent from FIGS. 4 and 5, the arms 58 of each pair extend away from the opposite edge regions of the base and toward each other, having spaced free ends 66 forming detents for notches 54 and 56 of the combination dials. Each arm may be generally T-shaped in plan. In the form shown the dial-indexing spring has parallel side portions 68 and 70 extending from the opposite edge regions of the base at which arms 58 originate. Locating lips 72 may be provided at the ends of one or both of the side portions 68 and 70.

In the preferred form, the dial-indexing spring is mounted within the frame 14 as shown in FIGS. 3 and 4, with the base 64 engaging the inner surface of the wall of the frame that forms the bottom of the frame when the frame is oriented as in FIGS. 3 and 4 and with the side portions 68 and 70 extending along opposite sides of the frame. Face plate 10 has pairs of depending bosses 74 that are adjacent to opposite ends, respectively, of the face plate and that engage the inner surface of the bottom of the frame to locate the face plate relative to that wall. Additional pairs of bosses 76 extend downwardly from the face plate between bosses 74 and engage corresponding portions of base 64 of dial spring 59 to hold the dial spring against the bottom of the frame. Bosses 76 are slightly shorter than bosses 74 to accommodate the thickness of base 64. Side portions 68 and 70 of the dial spring are located between the bosses and the side walls of frame 14, as shown in FIG. 4, to position the dial spring transversely of the frame. Locating lips 72 bend around corresponding bosses 74, as shown in FIGS. 3 and 4, to position the dial spring longitudinally of the frame. When so-positioned, the dial spring is located so that arms 58 of each pair extend toward the periphery of a corresponding combination dial as shown in FIG. 4. The free ends 66 of each pair of arms enter successive indexing notches 54 (or 54 and 56) of the dial and are curved for smooth camming engagement with the notches.

By virtue of its construction, the dial spring may be used interchangeably in both left-hand and right-hand combination locks, so that only one type of dial spring need be manufactured. Notches 78 in the base 64 of the dial spring (FIG. 5) provide clearance for the combination-finding probe inserted in openings 60 of the frame, as described above, and when the dial spring is properly positioned in left and right-hand locks, notches 78 will be properly located relative to openings 60 and to notches 62 in sleeves 28. In the right-hand lock illustrated in FIG. 3 notches 78 are open to the right, while in the left-hand lock the notches are open to the left (the dial spring being turned 180° from the position of FIG. 3).

Since the peripheries of the left and right-hand dials 18 have the same configuration, as is apparent in FIGS. 6 and 7, with the zero-stop notches 56 having the same construction in both left and right-hand dials, it is necessary that the relationship between the dials and the dial spring arms be the same for both left and right-hand locks if all the dials are to have the same action. By the provision of a pair of spring arms for each dial, this result is achieved even though the dial spring is turned 180° between left and right-hand locks, as stated. Moreover, the provision of a pair of spring arms for each dial provides improved indexing action as the dials are turned (in either direction) to number positions. The dials are held more firmly in place in any number position and have improved "feel" when turned.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. In a combination lock having a shaft, a plurality of combination dials supported for rotation on the shaft, each dial having combination indicia spaced about its periphery and having indexing members spaced about its periphery and disposed so that an indexing member is located between each pair of successive indicia, and latch means operable to an open position only when the dials are turned to a predetermined orientation, the improvement comprising dial-indexing spring means including a base, and a pair of resilient arms for each of the dials, respectively, the arms of each pair originating at opposite edge regions of the base and extending away from said opposite edge regions of the base toward each other and toward the periphery of the corresponding dial and having free ends engaging indexing members, respectively, of the corresponding dial.

2. A combination lock in accordance with claim 1, wherein the spring is formed of a single strip of springy material with the arms struck from the base so that successive pairs of arms are located at opposite sides of successive base portions.

3. A combination lock in accordance with claim 1, wherein the lock comprises a frame and the base engages a bottom wall of the frame and has side portions extending from the opposite edge regions along opposite side walls of the frame.

4. A combination lock in accordance with claim 3, wherein the lock has a face plate with bosses that hold the base against the bottom wall of the frame.

5. A combination lock in accordance with claim 1, wherein each indexing member comprises a notch and the free ends of the arms are shaped for camming engagement with the associated notches.

6. A dial spring for a combination lock of the type having a shaft, a plurality of combination dials supported for rotation on the shaft, each having combination indicia spaced about its periphery and having indexing members spaced about its periphery and disposed so that an indexing member is located between each pair of successive indicia, and latch means operable to an open position only when the dials are turned to a predetermined orientation, said spring comprising a generally rectangular sheet of spring metal including a base from which successive pairs of arms extend for cooperation with successive dials, respectively, the arms of each pair originating at opposite edge regions of the base and extending away from said opposite edge regions of the base and toward each other and having spaced free ends adapted to engage associated indexing members of a corresponding dial.

7. A dial spring in accordance with claim 6, wherein the arms are struck from the base so that successive pairs of arms are located at opposite sides of successive base portions.

8. A dial spring in accordance with claim 7, wherein the base has parallel side portions extending from the opposite edge regions thereof.

9. A dial spring in accordance with claim 8, wherein at least one of the side portions has a locating lip at each end thereof.

10. For use on a luggage case to hold a lid of the case locked closed, left and right combination locks, each lock having a housing, a shaft supported in the housing, a plurality of combination dials supported for rotation on the shaft, each dial having sequential combination indicia spaced about its periphery and having indexing notches spaced about its periphery and disposed so that an indexing notch is located between each pair of successive indicia, the housing having slots through which corresponding dials protrude and through which the combination indicia of the dials are exposed to view, the combination indicia of the dials of both locks having the same viewing orientation and having the same sequence as the dials are turned in the same direction, each lock having latch means operable by a manual actuator to an open position only when the dials are turned to a predetermined orientation, the latch means of the left and right locks, as perceived by the user, operating as mirror images of each other but comprising parts that are substantially identical, the locks also having substantially identical dial-indexing springs, each including a generally rectangular base, and a pair of resilient arms for each of the dials, respectively, the arms of each pair originating at opposite edge regions of the base and extending away from said opposite edge regions of the base toward each other and toward the periphery of the corresponding dial and having free ends engaging successive indexing notches of the corresponding dial.

11. Locks in accordance with claim 10, wherein the indexing notches of all the dials, except one notch of each dial, have the same shape permitting the notches to pass the associated resilient arms regardless of the direction of rotation of the dials, and wherein said one notch of each dial is constructed to abut an associated resilient arm when the dial is turned in a predetermined direction to a predetermined position and to stop further rotation of the dial in that direction, all of the dials having the same cooperative action with the associated pairs of resilient arms.

* * * * *